US009045204B1

(12) United States Patent
Murphy

(10) Patent No.: US 9,045,204 B1
(45) **Date of Patent: *Jun. 2, 2015**

(54) METHOD AND APPARATUS FOR WAKE ENLARGEMENT SYSTEM

(71) Applicant: Michael Murphy, Canyon Lake, CA (US)

(72) Inventor: Michael Murphy, Canyon Lake, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/187,256

(22) Filed: Feb. 22, 2014

Related U.S. Application Data

(63) Continuation of application No. 13/337,118, filed on Dec. 24, 2011, now Pat. No. 8,739,723.

(60) Provisional application No. 61/460,064, filed on Dec. 27, 2010.

(51) Int. Cl.
*B63B 39/03* (2006.01)
*B63B 35/85* (2006.01)
*B63B 9/00* (2006.01)

(52) U.S. Cl.
CPC .. *B63B 35/85* (2013.01); *B63B 9/00* (2013.01)

(58) Field of Classification Search
USPC ..... 114/125
IPC ..... B63B 39/03,9/00, 35/85
See application file for complete search history.

(56) References Cited

U.S. PATENT DOCUMENTS

| | | | | |
|---|---|---|---|---|
| 3,085,535 | A | 4/1963 | Hunt | |
| 3,186,371 | A | 6/1965 | Moore | |
| 3,747,554 | A * | 7/1973 | Allen | 114/218 |
| 4,341,177 | A | 7/1982 | Miyazaki et al. | |
| 4,528,927 | A | 7/1985 | Iizuka et al. | |
| 5,215,025 | A | 6/1993 | Talmor | |
| 5,645,003 | A | 7/1997 | Grinde | |
| 6,044,788 | A | 4/2000 | Larson et al. | |
| 6,234,099 | B1 | 5/2001 | Jessen et al. | |
| 6,427,616 | B1 | 8/2002 | Hagen | |
| 6,953,002 | B2 | 10/2005 | Jessen et al. | |
| 8,739,723 | B1 * | 6/2014 | Murphy | 114/125 |

OTHER PUBLICATIONS

Powerboat magazine article "Wake-Up call", Apr. 1997, 4 pages ending at p. 51.
Performance Report Wakeboard "Fineline Wave", vol. 1, Issue 1, 1997, p. 22.
Performance Report Wakeboard "Ultimate Gear", vol. 1, Issue 3, 1997, p. 45.

* cited by examiner

*Primary Examiner* — Stephen Avila
(74) *Attorney, Agent, or Firm* — Heimlich Law, PC; Alan Heimlich, Esq.

(57) ABSTRACT

A Method and Apparatus for Wake Enlargement System have been disclosed. By using water pick ups that are mounted or deployable on a boat controlled filling of ballast tanks is possible without the use of pumps.

4 Claims, 10 Drawing Sheets

METHOD AND APPARATUS FOR WAKE ENLARGEMENT SYSTEM

RELATED APPLICATION

The present Application for Patent is related to, and claims priority to, U.S. Patent Application No. 61/460,064 titled "Wake Enlargement System (Pure Vert #3)" filed Dec. 27, 2010, and is hereby incorporated herein by reference. The present Application for Patent is related to, and claims priority to, U.S. patent application Ser. No. 13/337,118 titled "Method and Apparatus for Wake Enlargement System" filed Dec. 24, 2011, now U.S. Pat. No. 8,739,723 issued Jun. 3, 2014, and is hereby incorporated herein by reference.

FIELD OF THE INVENTION

The present invention pertains to water sports. More particularly, the present invention relates to a Method and Apparatus for Wake Enlargement System.

BACKGROUND OF THE INVENTION

In several water sports, for example, but not limited to, wakeboarding, waterskiing, etc., "getting air" is desirable. One way of "getting air" is to launch oneself off a wave into the air. This wave can be created by a boat, for example, towing person(s) engaging in the water sport. This wave created by the boat is often referred to as a wake. To create a wake a boat must displace water as it moves forward. One approach to displace as much water as possible is to lower a boat in the water. This lowering can be achieved by placing ballast(s) in the boat. However having a boat lower in the water, that is displacing more water, requires more energy to get up to speed since more water needs to be displaced which requires more energy. This presents a problem.

One approach is to use water as a ballast. In the past, such systems have been filled by either water pumps or flooding through the bottom of the boat. However, water pumps are complicated, need a source of power, are heavy, etc., and so this presents a problem. Using a flooding system will only fill ballast tanks to the waterline, and so this presents a problem.

BRIEF DESCRIPTION OF THE DRAWINGS

The invention is illustrated by way of example and not limitation in the figures of the accompanying drawings in which.

DETAILED DESCRIPTION

In one embodiment of the invention, the system does not use pumps to fill ballast tank(s). In one embodiment of the invention, the system does not use flooding to fill ballast tank(s). In one embodiment of the invention, the system does not use gates or valves.

In one embodiment of the invention, the system does not use pumps to fill some ballast tank(s). In one embodiment of the invention, the system does not use gates or valves for controlling filling/emptying of some of the ballast tank(s).

In one embodiment of the invention, the system uses a combination of no valves, and valves to control filling/emptying of some of the ballast tank(s).

In one embodiment of the invention, the system works on water pressure to fill ballast tank(s). In one embodiment of the invention, the system works on water pressure developed while the boat is in forward motion to fill ballast tank(s). In one embodiment of the invention, water pressure developed by the boat in forward motion is used to force feed ballast tank(s) and uses an air venting system.

In one embodiment of the invention, the system uses gravity to empty ballast tank(s). In one embodiment of the invention, the system uses the boat's forward motion to empty ballast tank(s). In one embodiment of the invention, the system uses gravity and the boat's forward motion to empty ballast tank(s).

In one embodiment of the invention, the system uses water pick-ups that are mounted through the bottom of the boat. In one embodiment of the invention, the system uses deployable water pick-ups that are mounted on the boat. In one embodiment of the invention, the system uses deployable water pick-ups that are mounted on the boat and which may be raised to eliminate drag on the boat as it is moving.

In one embodiment of the invention, the system uses deployable water pick-ups that are mounted on the boat transom. In one embodiment of the invention, the system uses deployable water pick-ups that are deployed on the boat transom. In one embodiment of the invention, the system uses deployable water pick-ups that are deployed past the boat transom.

In one embodiment of the invention, using the force feed water pick-up allows the ballast tank(s) to be taller than the waterline and thus being able to fill ballast tank(s) above the waterline thereby adding more water which increases the weight on the boat which results in a bigger wake.

In one embodiment of the invention, using the force feed water pick-up creates pressure without the use of pumps, diversion valves, check valves, etc.

Figure 1:
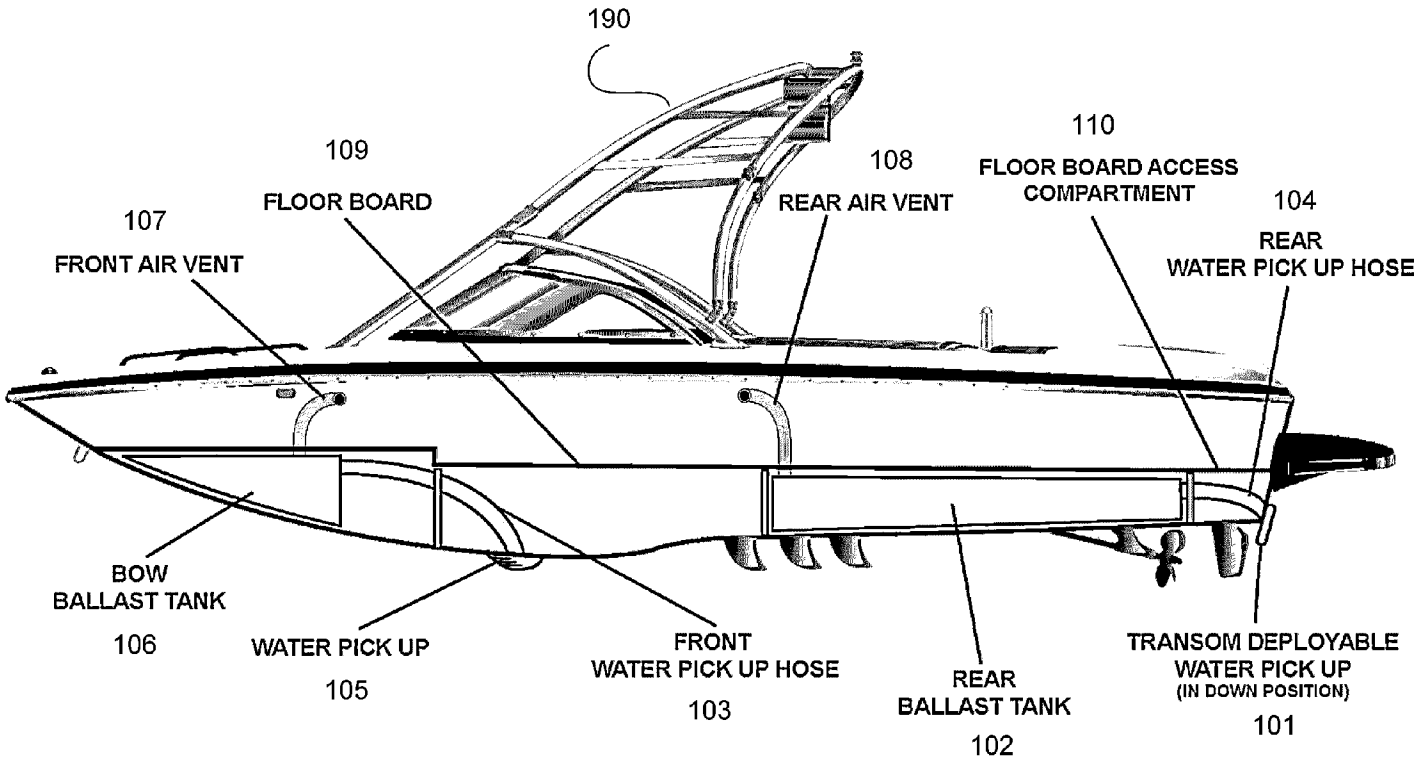
FIG. 1 illustrates a side view of a water ballast pick up system.

FIG. 1 illustrates, generally at 100, one embodiment of the invention showing a side view with major component blocks and functions. Generally at 190 is boat. At 101 is a transom deployable water pick up, shown here in the down position. At 104 is a rear water pick up hose. At 102 is a rear ballast tank. At 103 is a front water pick up hose. At 105 is a water pick up (also spelled pick-up). At 106 is a bow ballast tank. At 107 is a front air vent. At 108 is rear air vent. At 109 is a floor board of the boat 190. At 110 is a floor board access compartment.

The water pick up, e.g. 105 as shown in FIG. 1 may be located anywhere along the hull of the boat 190. That is it may be located at any position from the bow to the stern and from the port side to the starboard side of the boat 190. The only requirement is that the water pick up be located below a waterline when the boat is moving through the water. In this way water is forced into the water pick up by the motion of the boat.

The transom deployable water pick up, for example 101 as shown in FIG. 1, is movable and when positioned below the bottom of the boat the motion of the boat will force water into the water pick up. When the deployable water pick up is at or above the bottom of the boat, water will not be forced into the water pick up by the motion of the boat.

Since the transom deployable water pick up, e.g. 101 as shown in FIG. 1 is movable, the rate of flow of water into/out of the ballast tank, for example, 102 as shown in FIG. 1 may be controlled by the position of the transom deployable water pick up. When fully below the bottom of the boat there is maximum pick up due to motion of the boat and when raised for example, out of the water, there will be no force from the water the boat is in.

To control the rate and/or amount of water entering a ballast tank, for example, bow ballast tank 106, one can throttle the air vent, for example 107 front air vent. Not shown would be a valve in line with the front air vent. A fully closed valve would not let additional water in as the compressed air pressure in the ballast tank equals that from the water pick up. This same approach may be used independently or jointly to control the rate and/or amount of water entering a rear ballast tank, for example, rear ballast tank 102.

In one embodiment a front and rear air vent, such as shown in FIG. 1 at 107 and 108 may be controlled together to achieve a preferred angle of inclination of the boat while accelerating and in motion. For example, by controlling the rate of fill and the amount of filling of the ballast tanks one can, for example, keep the boat level in the water.

For example during initial acceleration, the bow may tend to rise which can be countered by filling the ballast tank with some water. As the boat begins to plane, the rear ballast tank and front ballast tanks can be filled with some water to maintain a level.

In one embodiment, for example, as illustrated in FIG. 1 there are no intervening valves located between water pick up 105 and the input to the bow ballast tank 106.

Figure 2:
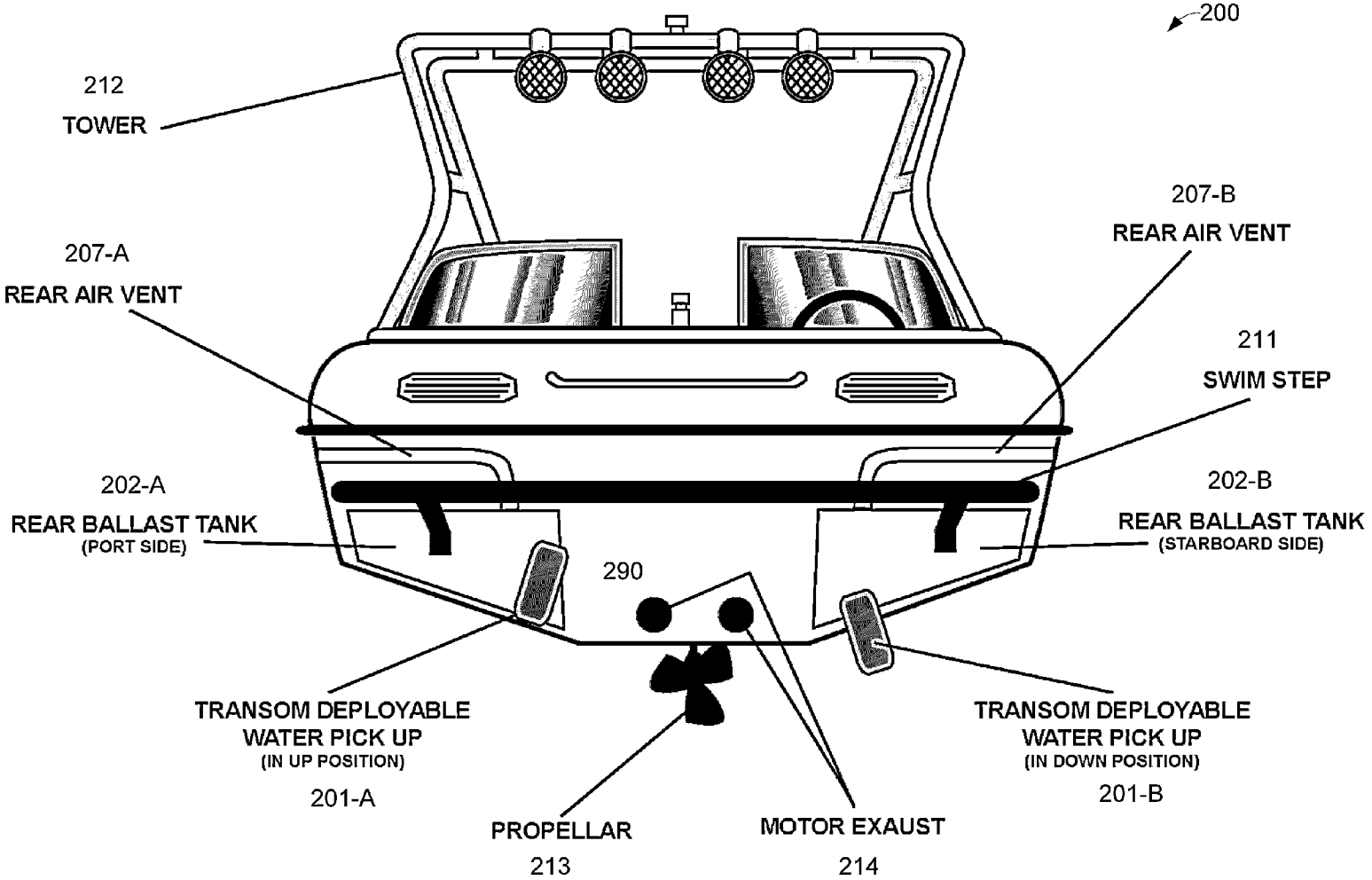
FIG. 2 illustrates a back view of a water ballast pick up system.

FIG. 2 illustrates, generally at 200, one embodiment of the invention showing a rear view with major component blocks and functions. Generally at 290 is boat. At 201-A is a transom deployable water pick up, shown here in the up position. At 201-B is a transom deployable water pick up, shown here in the down position. At 202-A is shown a rear ballast tank located on the port side. At 202-B is shown a rear ballast tank located on the starboard side. At 207-A is shown a rear air vent located on the port side for rear ballast tank 202-A. At 207-B is shown a rear air vent located on the starboard side for rear ballast tank 202-B. At 211 is a swim step located on the rear of the boat. At 212 is a tower. At 213 is a propeller. At 214 is a motor exhaust.

Note that while an air vent is shown located on the same side as the ballast tank it is connected to, the invention is not so limited. For example, a rear ballast tank located, for example on the port side may vent on the starboard side, the stern of the boat, etc.

Figure 3:
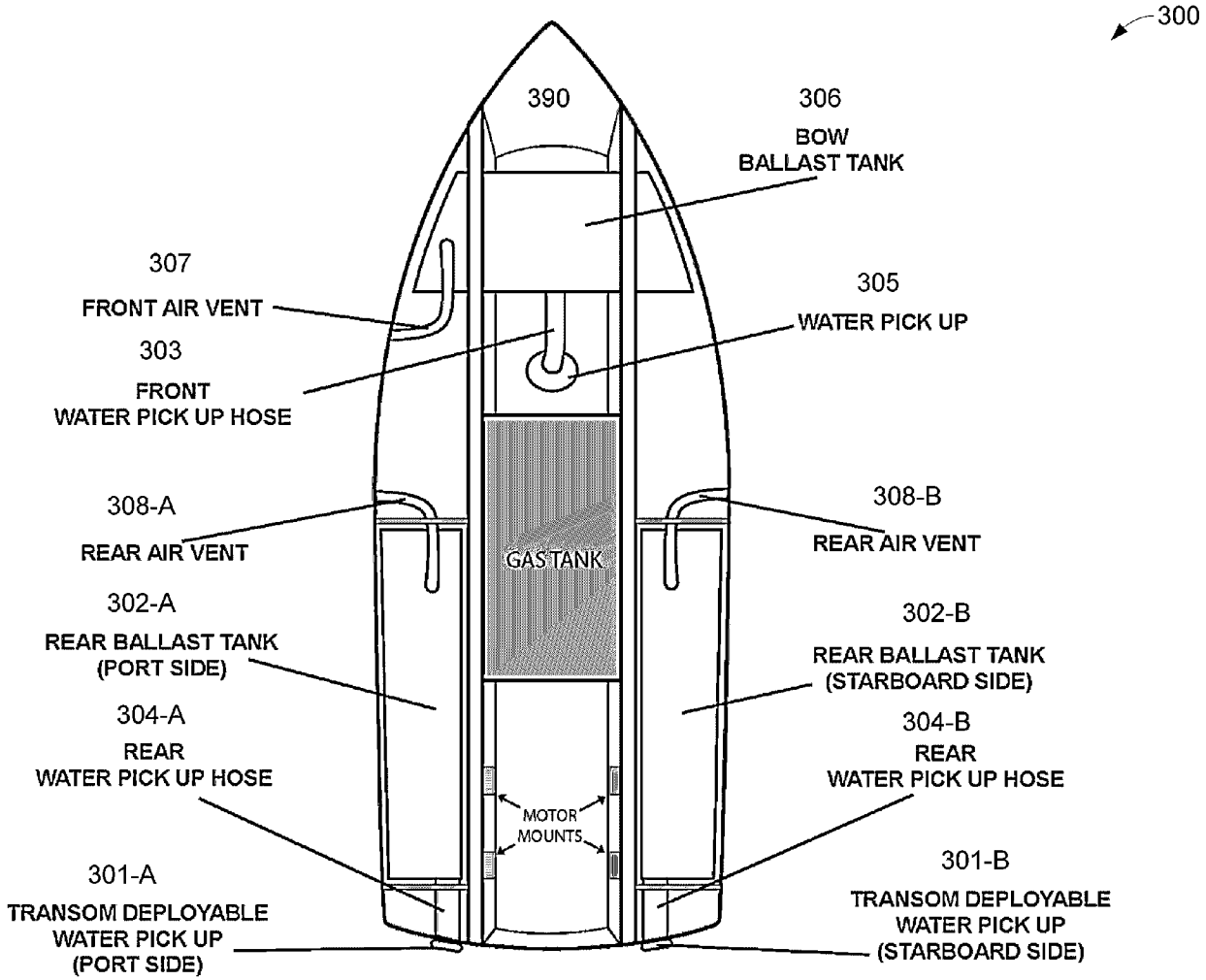
FIG. 3 illustrates a tip view of a water ballast pick up system.

FIG. 3 illustrates, generally at 300, one embodiment of the invention showing a top view with major component blocks and functions. Generally at 390 is boat. At 301-A is a transom deployable water pick up on the port side of the boat 390. At 301-B is a transom deployable water pick up on the starboard side. At 302-A is shown a rear ballast tank located on the port side. At 302-B is shown a rear ballast tank located on the starboard side. At 304-A is a rear water pick up hose on the port side. At 304-B is a rear water pick up hose on the starboard side. At 308-A is shown a rear air vent located on the port side for rear ballast tank 302-A. At 308-B is shown a rear air vent located on the starboard side for rear ballast tank 302-B. At 305 is a front water pick up. At 303 is a front water pick up hose. At 307 is a front air vent. At 306 is a bow ballast tank.

While FIG. 3 illustrates one bow ballast tank and two rear ballast tanks with their associated pick ups and air vents, the invention is not so limited. For example, there may be one or more bow ballast tanks having one or more pick ups and one or more air vents. Likewise there may be one or more rear ballast tanks having one or more pick ups and one or more air vents.

While FIG. 3 illustrates for example the water pick up 305 being substantially located on a centerline from the bow to the stern, the invention is not so limited and the water pick up, for example, water pick up 305 may be mounted anywhere on the hull of boat 390. Likewise, while FIG. 3 illustrates for example the transom deployable water pick ups being on the transom, deployable water pick ups may be deployed anywhere from the boat. So for example, but not limited to water pick up 305 may be located in the stern of the boat 390 with the front water pick up hose running from the stern to the bow ballast tank. Likewise deployable water pick ups similar to the transom deployable pickups may be located anywhere, for example, but not limited to the bow of boat 390 and would have the water pick up hose running to the rear ballast tank(s).

Figure 4:
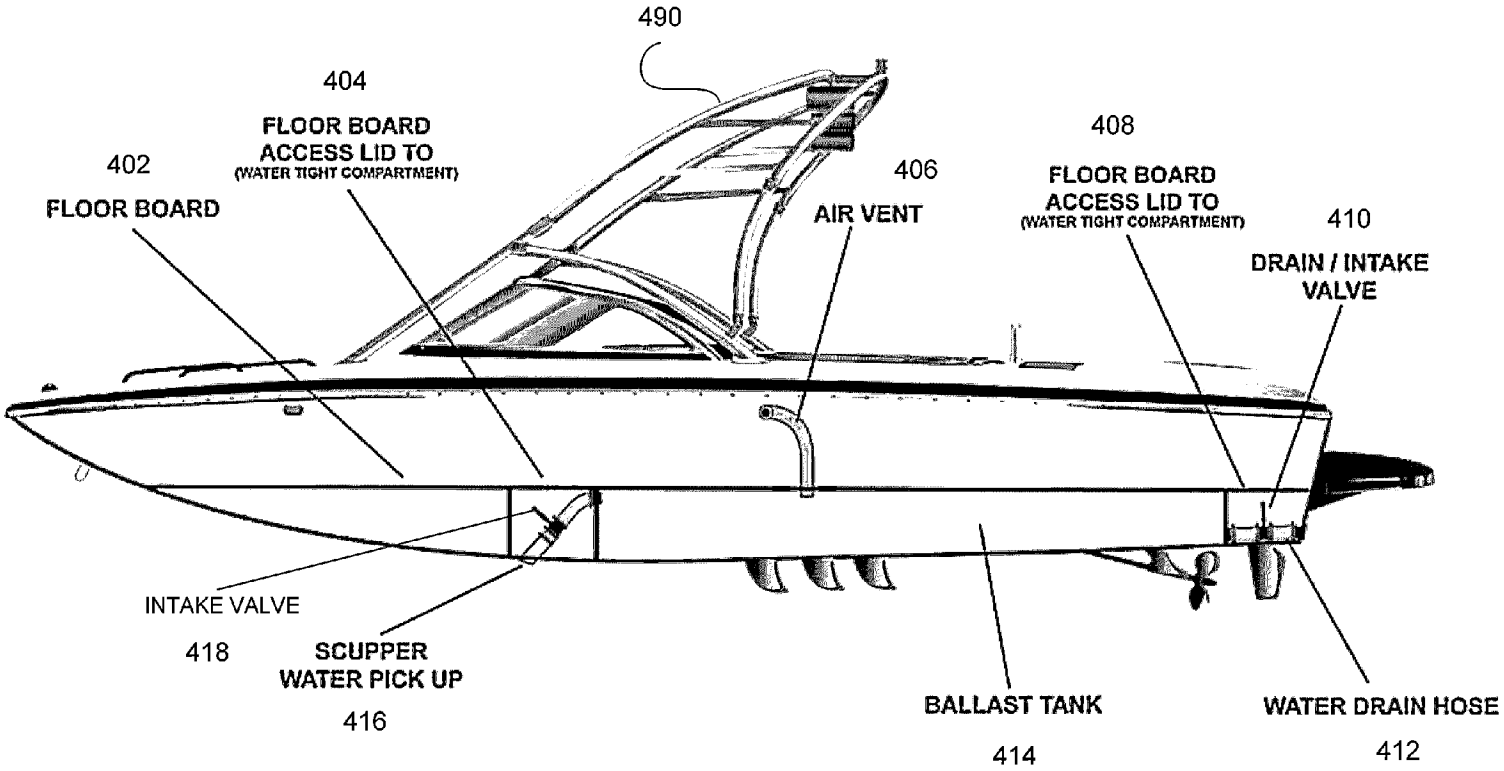
FIG. 4 illustrates a side view of a scupper water pick up system.

FIG. 4 illustrates, generally at 400, one embodiment of the invention showing a side view with major component blocks and functions. Generally at 490 is boat. At 402 is a floor board. At 404 is a floor board access lid to a first water tight compartment. At 406 is an air vent. At 408 is a floor board access lid to a second water tight compartment. At 410 is a drain/intake valve. At 412 is a water drain hose. At 414 is a ballast tank. At 416 is a scupper water pick up. At 418 is an intake valve.

In one embodiment, for example, as illustrated in FIG. 4, the intake valve 418 may be used to throttle water entering and exiting the ballast tank 414. For example, if the boat 490 is in forward motion water from the scupper water pick up will have a force to try and enter ballast tank 414. Intake valve 418 can control the water flow. If the ballast tank 414 has water above a water line, then there will be a force exerted for water to flow from the ballast tank 414 through the scupper water pick up 416. If this force is greater than the force for water to enter the scupper water pick up 416, then water will exit. Intake valve 418 can control this water flow as well. If the intake valve 418 is closed then water can neither enter nor exit.

The intake valve 418 may be controlled manually, electrically, pneumatically, hydraulically, or by any other means that provides mechanical movement.

In one embodiment, for example, as illustrated in FIG. 4, the scupper water pick up 416 extends beyond the bottom of the hull and is mounted at an angle. The distance beyond the hull bottom and the angle with respect to the hull, as well as, for example, the diameter of the scupper water pick up may be varied to provide the fill rate desired at a given speed of the boat 490. In one embodiment for example the angle of the scupper water pick up may be 10 degrees.

Drain/intake valve 410 similarly can control draining of water and intake of water. When ballast tank 414 has water in it and the boat is accelerating forward there will be exerted a force as the water attempts to exit through the drain/intake valve 410 and out the water drain hose 412.

Intake valve 418 may be used in conjunction with a valve (not shown in FIG. 4) inline with air vent 406 to control entry/exit of water into/out of ballast tank 414.

Figure 5:
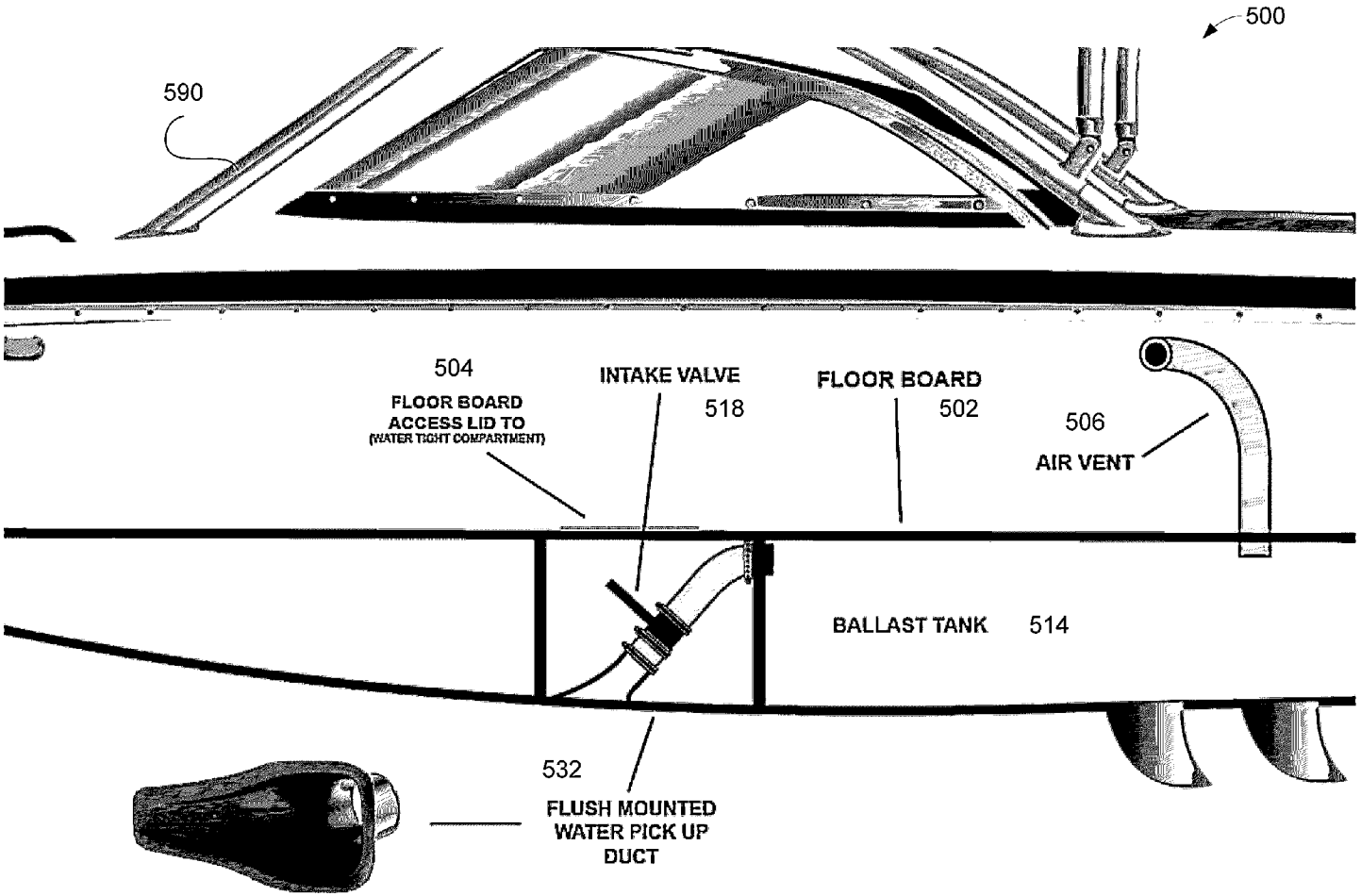
FIG. 5 illustrates a side view of a flush mount water duct system.

FIG. 5 illustrates, generally at 500, one embodiment of the invention showing a side view with major component blocks and functions. Generally at 590 is boat. At 504 is a floor board access lid to a first water tight compartment. At 518 is an intake valve. At 502 is a floor board. At 506 is an air vent. At 514 is a ballast tank. At 532 is flush mounted water pick up duct. As may be seen the flush mounted water pick up duct 532 has a elongated front scoop toward the bow and a more abrupt scoop toward the stern.

The flush mounted water pick up duct 532 has the advantage of not protruding beyond the outer surface of the hull. This provides a smoother surface than a protrusion.

Figure 6:
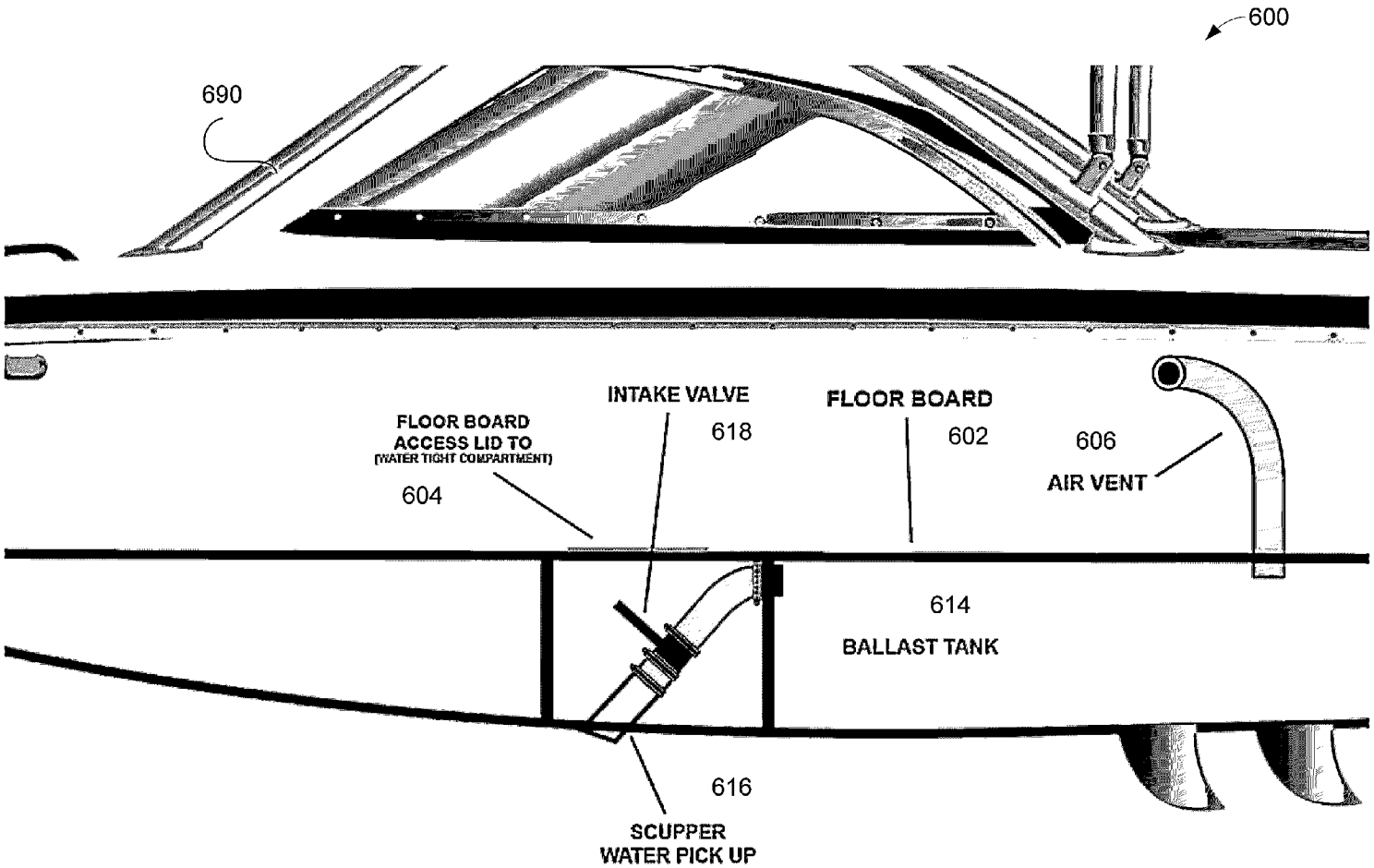
FIG. 6 illustrates a side view of a scupper water pick up system.

In one embodiment, for example, as illustrated in FIG. 6, the intake valve 618 may be used to throttle water entering and exiting the ballast tank 614. For example, if the boat 690 is in forward motion water from the scupper water pick up will have a force to try and enter ballast tank 614. Intake valve 618 can control the water flow. If the ballast tank 614 has water above a water line, then there will be a force exerted for water to flow from the ballast tank 614 through the scupper water pick up 616. If this force is greater than the force for water to enter the scupper water pick up 616, then water will exit. Intake valve 618 can control this water flow as well. If the intake valve 618 is closed then water can neither enter nor exit.

The intake valve 618 may be controlled manually, electrically, pneumatically, hydraulically, or by any other means that provides mechanical movement. In this embodiment as illustrate in FIG. 6 the scupper water pick up 616 extends partially beyond the surface of the hull.

Figure 7:
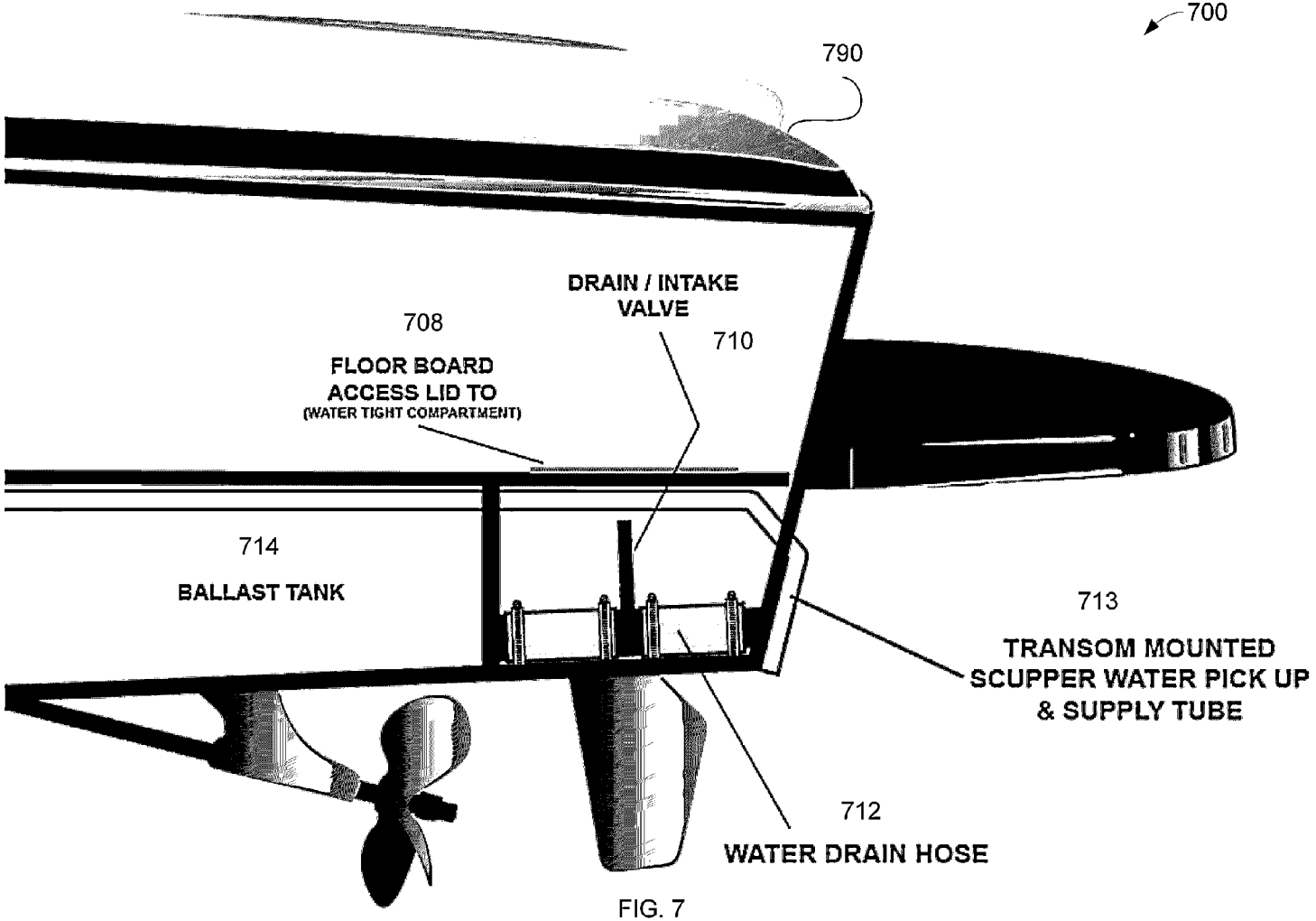
FIG. 7 illustrates a side view of a water drain hose system

FIG. 7 illustrates, generally at 700, one embodiment of the invention showing a side view with major component blocks and functions. Generally at 790 is boat.

At 708 is a floor board access lid to a water tight compartment. At 710 is a drain/intake valve. At 712 is a water drain hose. At 714 is a ballast tank. At 713 is a transom mounted scupper water pick up and supply tube.

Drain/intake valve 710 can control draining of water and intake of water. When ballast tank 714 has water in it and the boat 790 is accelerating forward there will be exerted a force as the water attempts to exit through the drain/intake valve 710 and out the water drain hose 712.

Figure 8:
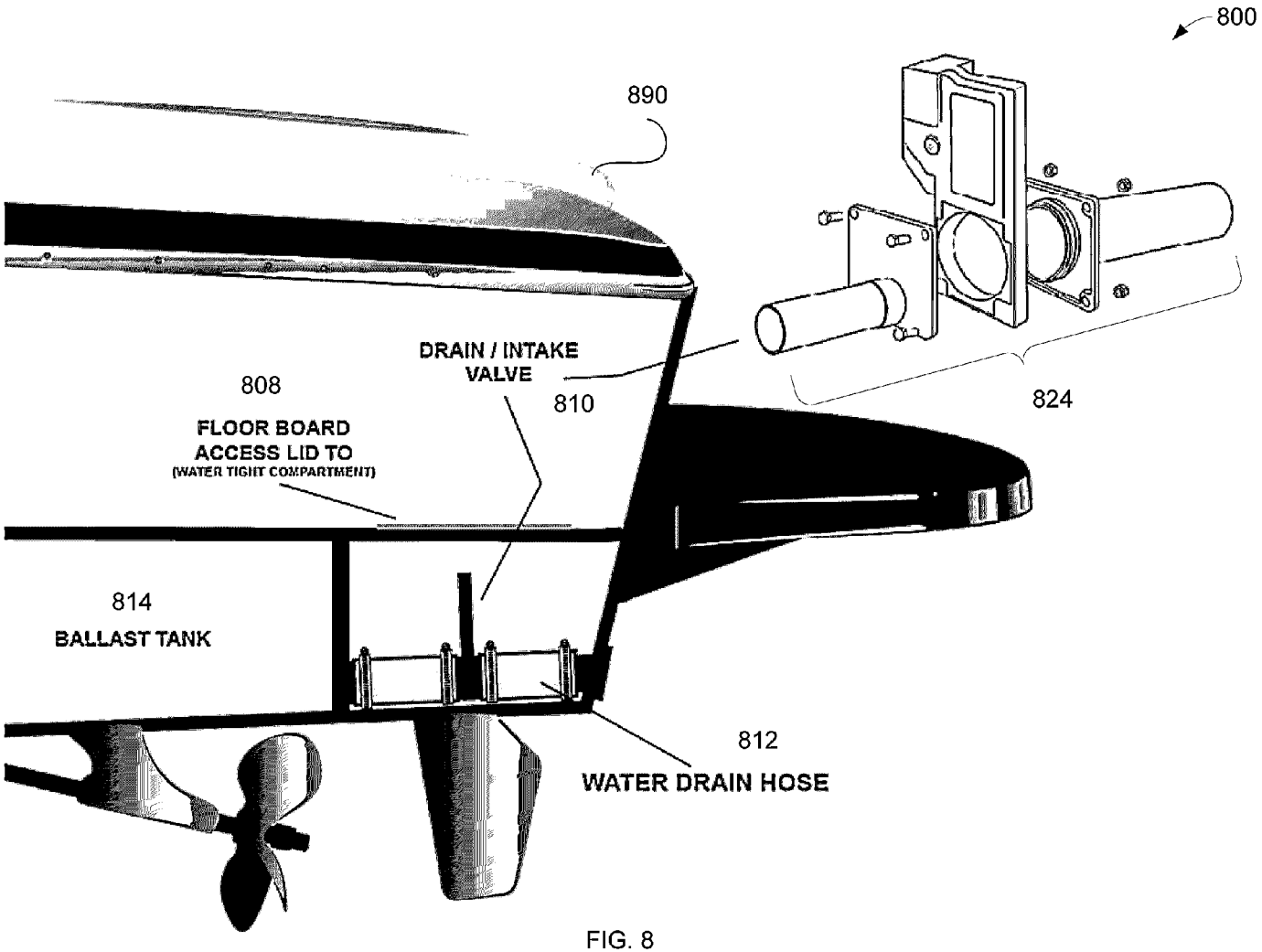
FIG. 8 illustrates a side view of a drain/intake valve system.

FIG. 8 illustrates, generally at 800, one embodiment of the invention showing a side view with major component blocks and functions. Generally at 890 is boat. At 808 is a floor board access lid to a water tight compartment. At 810 is a drain/intake valve. At 812 is a water drain hose. At 814 is a ballast tank. At 824 is an exploded view of one embodiment of a drain/intake valve 810 which is an electrically activated gate valve.

Drain/intake valve 810 can control draining of water and intake of water. When ballast tank 814 has water in it and the boat 890 is accelerating forward there will be exerted a force as the water attempts to exit through the drain/intake valve 810 and out the water drain hose 812.

Figure 9:
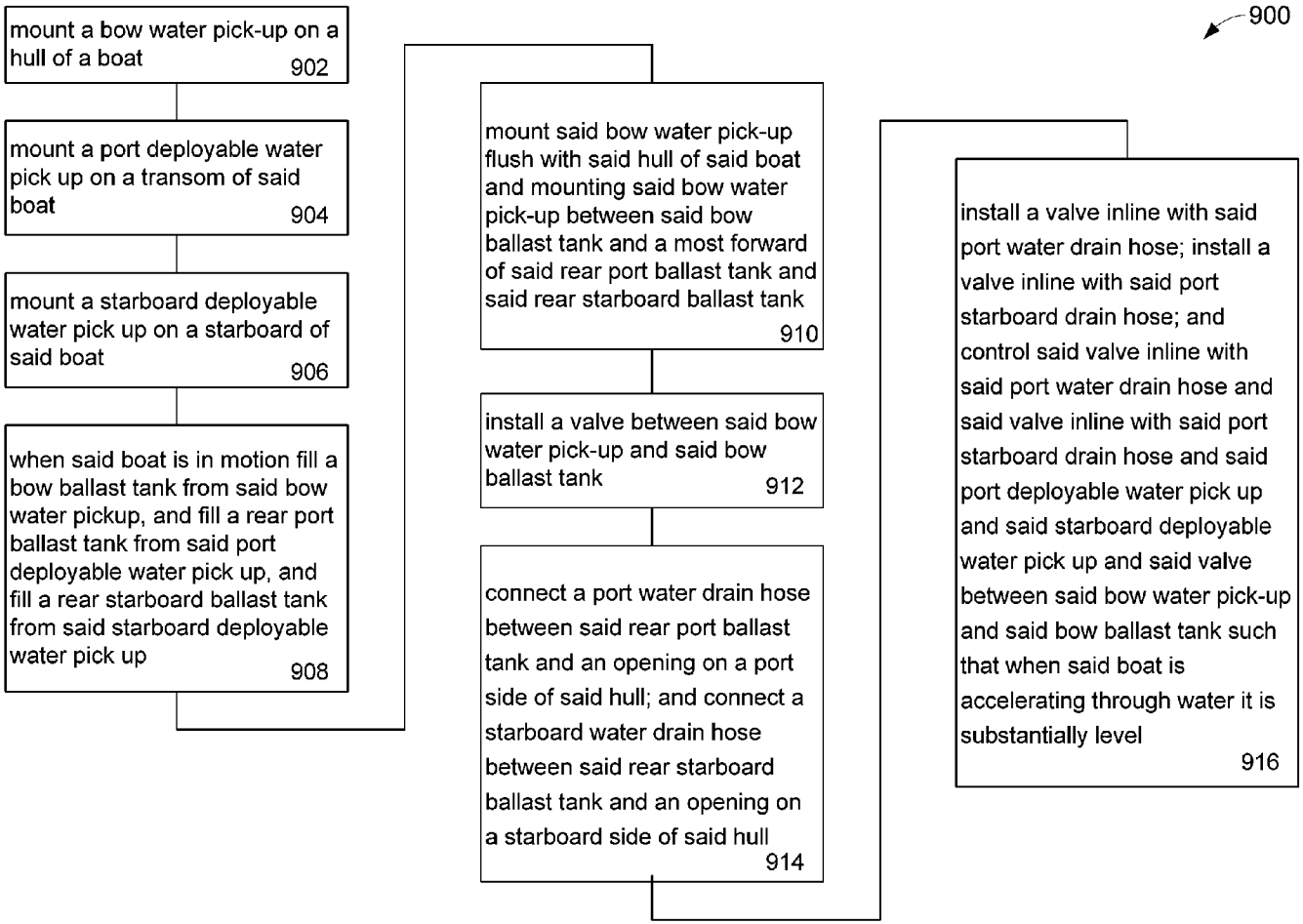
FIG. 9 illustrates a flowchart.

FIG. 9 illustrates, generally at 900, one embodiment of the invention showing a flow chart. At 902 mount a bow water pick-up on a hull of a boat. At 904 mount a port deployable water pick up on a transom of said boat. At 906 mount a starboard deployable water pick up on a starboard of said boat. At 908 when said boat is in motion fill a bow ballast tank from said bow water pickup, and fill a rear port ballast tank from said port deployable water pick up, and fill a rear starboard ballast tank from said starboard deployable water pick up. 910, 912, 914, and 916 are each individually optional. At 910 mount said bow water pick-up flush with said hull of said boat and mounting said bow water pick-up between said bow ballast tank and a most forward of said rear port ballast tank and said rear starboard ballast tank. At 912 install a valve between said bow water pick-up and said bow ballast tank. At 914 connect a port water drain hose between said rear port ballast tank and an opening on a port side of said hull; and connect a starboard water drain hose between said rear starboard ballast tank and an opening on a starboard side of said hull. At 916 install a valve inline with said port water drain hose; install a valve inline with said port starboard drain hose; and control said valve inline with said port water drain hose and said valve inline with said port starboard drain hose and said port deployable water pick up and said starboard deployable water pick up and said valve between said bow water pick-up and said bow ballast tank such that when said boat is accelerating through water it is substantially level.

Figure 10:
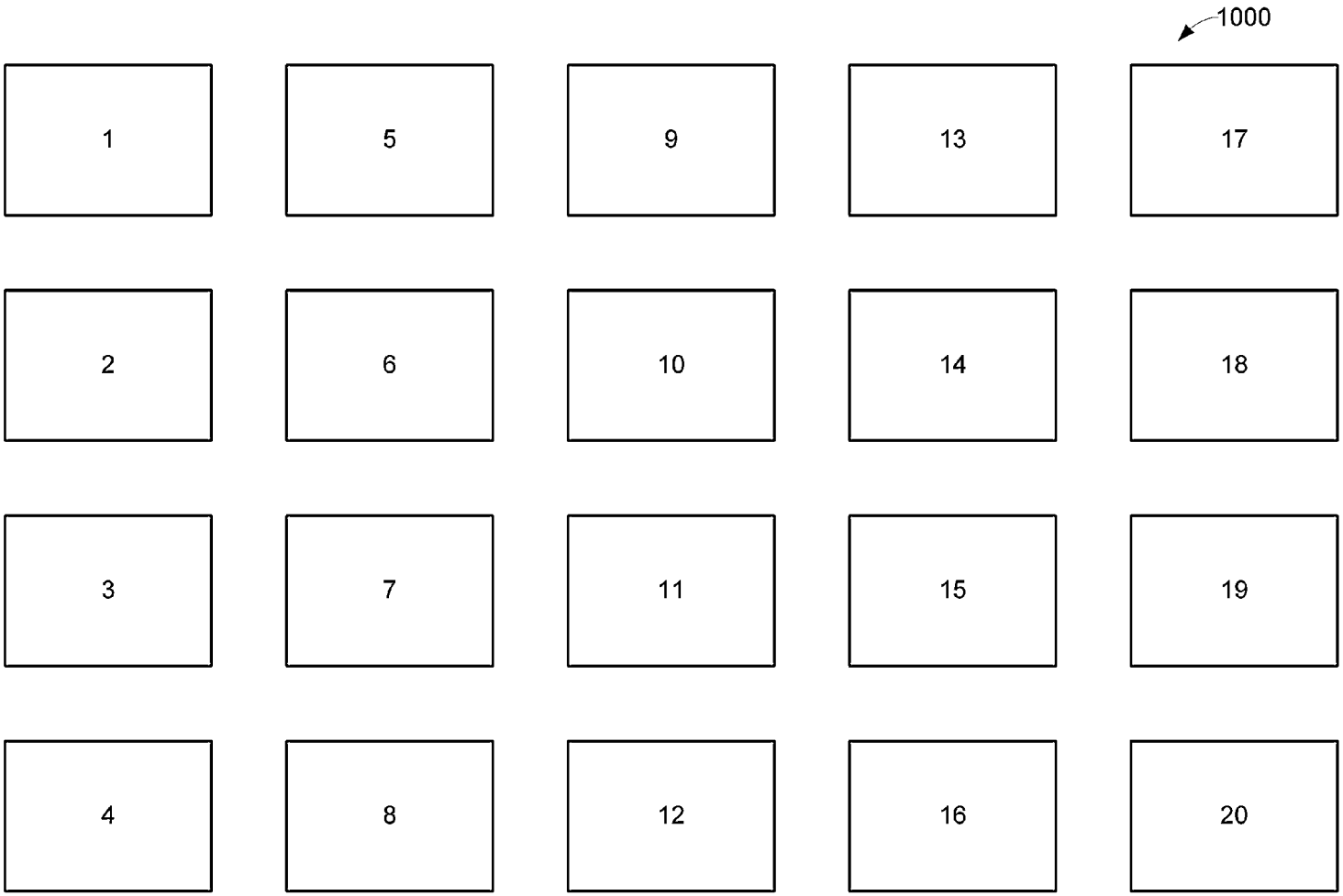
FIG. 10 illustrates various embodiments.

FIG. 10 illustrates, generally at 1000, various embodiments of the invention showing the following. 1. A wake enlargement system for improving a wake generated by a boat, the system comprising: said boat having a hull having a bow and a stern; a water pick-up having an input and an output, said water pick-up input mounted on a bottom surface of said hull; and one or more ballast tanks having a water input and an air output, said ballast water input in operative communication with said water pick-up output. 2. The system of claim 1 wherein said water pick-up extends beyond an outer surface of said bottom surface of said hull. 3. The system of claim 1 wherein said water pick-up is flush mounted with an outer surface of said bottom surface of said hull. 4. The system of claim 1 wherein said one or more ballast tanks is one bow ballast tank centered about a centerline running from said stern to said bow of said hull, and said water pick-up is located aft of said bow ballast tank. 5. The system of claim 4 wherein said water pick-up is centered about said centerline running from said stern to said bow of said hull. 6. The system of claim 5 wherein said ballast water input in operative communication with said water pick-up output is a direct connection without any intervening valves. 7. The system of claim 1 wherein said water pick-up extends beyond an outer surface of said bottom surface of said hull, and wherein said one or more ballast tanks is one bow ballast tank centered about a centerline running from said stern to said bow of said hull, and wherein said water pick-up is located aft of said bow ballast tank. 8. A wake enlargement system for improving a wake generated by a boat, the system comprising: said boat having a hull having a bow and a stern; a deployable water pick-up having an input and an output, said deployable water pick-up input mounted on said hull; one or more ballast tanks having a water input and an air output, said ballast water input in operative communication with said water deployable pick-up output; and. wherein said deployable water pick up is mounted on a transom of said boat. 9. The system of claim 8 wherein said deployable water pick up mounted on said transom of said boat deploys by sliding substantially vertically and substantially parallel to said transom. 10. The system of claim 9 wherein a portion of said deployable water pick up is adjustable from a position below a bottom of said transom of said boat to a position above said bottom of said transom of said boat. 11. The system of claim 10 wherein there are two independently said deployable water pick ups, each said deployable water pick up connected respectively to a separate rear ballast tank and wherein each said deployable water pick up is deployable independent of the other. 12. A method comprising: mounting a ballast tank in a boat; mounting a scupper water pick up on a bottom of a hull of said boat, wherein a portion of said scupper water pick up extends beyond said bottom of said hull of said boat; mounting a valve in said boat; connecting an input to said valve to said scupper water pick up; and connecting an output from said valve to said ballast tank. 13. The method of claim 12 further comprising mounting said ballast tank forward of said scupper water pick up. 14. The method of claim 12 further comprising mounting said ballast tank aft of said scupper water pick up. 15. The method of claim 13 further comprising mounting said ballast tank so that a portion of said ballast tank is above a waterline when said ballast tank is empty and said boat is at rest in water. 16. The method of claim 14 further comprising mounting said ballast tank so that a portion of said ballast tank is above a waterline when said ballast tank is empty and said boat is at rest in water. 17. The method of claim 16 further comprising actuating said valve to control a rate of water pick up from said scupper water pickup. 18. The method of claim 16 wherein said ballast tank has an air vent with a air vent valve 19. The method of claim 18 further comprising actuating said air vent valve to control a rate of water pick up from said scupper water pickup. 20. The method of claim 18 further comprising actuating said valve and said air vent valve to control a rate of water pick up from said scupper water pickup.

Thus a Method and Apparatus for Wake Enlargement System have been described.

For purposes of discussing and understanding the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

As used in this description, "substantially" or "substantially equal" or similar phrases are used to indicate that the items are very close or similar. Since two physical entities can never be exactly equal, a phrase such as ""substantially equal" is used to indicate that they are for all practical purposes equal.

As used in this description "pick up" or "pickup" or "pick-up" or similar language refers to the same thing.

It is to be understood that in any one or more embodiments of the invention where alternative approaches or techniques are discussed that any and all such combinations as might be possible are hereby disclosed. For example, if there are five techniques discussed that are all possible, then denoting each technique as follows: A, B, C, D, E, each technique may be either present or not present with every other technique, thus yielding 2^5 or 32 combinations, in binary order ranging from not A and not B and not C and not D and not E to A and B and C and D and E. Applicant(s) hereby claims all such possible combinations. Applicant(s) hereby submit that the foregoing combinations comply with applicable EP (European Patent) standards. No preference is given any combination.

Thus a Method and Apparatus for Wake Enlargement System have been described.

What is claimed is:

1. A wake enlargement system for improving a wake generated by a boat, the system comprising:

said boat having a hull having a bow and a stern;

a deployable water pick-up having an input and an output, said deployable water pick-up input mounted on said hull and connected through a first hose to a valve;

one or more ballast tanks each having a single water input and an air output, said ballast water input in operative communication with said water deployable pick-up output through a second hose connected to said valve; and wherein said deployable water pick up is mounted on a transom of said boat.

2. The system of claim 1 wherein said deployable water pick up mounted on said transom of said boat deploys by sliding substantially vertically and substantially parallel to said transom.

3. The system of claim 2 wherein a portion of said deployable water pick up is adjustable from a position below a bottom of said transom of said boat to a position above said bottom of said transom of said boat.

4. The system of claim 3 wherein there are two independently said deployable water pick ups, each said deployable water pick up connected respectively to a separate rear ballast tank and wherein each said deployable water pick up is deployable independent of the other.

* * * * *